United States Patent [19]

Markisello

[11] Patent Number: 4,712,403

[45] Date of Patent: Dec. 15, 1987

[54] METHOD OF PROTECTING LOCK CYLINDERS FROM BEING WRENCHED OR PULLED

[76] Inventor: Frank Markisello, 91-10 Liberty Ave., Ozone Park, N.Y. 11417

[21] Appl. No.: 46,572

[22] Filed: May 6, 1987

[51] Int. Cl.[4] ..... E05B 15/02

[52] U.S. Cl. ..... 70/417; 70/418; 70/451; 70/452; 70/381

[58] Field of Search ..... 70/451, 452, 381, 417, 70/418

[56] References Cited

U.S. PATENT DOCUMENTS

| | | | |
|---|---|---|---|
| 3,083,563 | 4/1963 | Greenwald | 70/417 |
| 3,899,907 | 8/1975 | Prehl | 70/452 |

FOREIGN PATENT DOCUMENTS

| | | | |
|---|---|---|---|
| 799147 | 11/1968 | Canada | 70/452 |
| 902144 | 6/1972 | Canada | 70/452 |
| 683331 | 2/1965 | Italy | 70/452 |
| 177900 | 6/1935 | Switzerland | 70/452 |

*Primary Examiner*—Robert L. Wolfe

[57] ABSTRACT

A method of protecting lock cylinders from being wrenched or pulled from the door, is provided and consists of a plate with a hole in the back top of the plate, which will accept the cylinder. So when the plate is slid up, the cylinder will lock into the milled groove in the bottom back of the plate, locking said cylinder into the back of the plate. There is a bolt hole through the top front of the plate, to allow the top of the plate to be tightened to the door. The cylinder will hold the bottom of the plate tight to the door.

4 Claims, 7 Drawing Figures

METHOD OF PROTECTING LOCK CYLINDERS FROM BEING WRENCHED OR PULLED

BACKGROUND OF THE INVENTION

1. Field of the Invention

The instant invention relates generally to lock cylinders and more specifically it relates to a method of protecting lock cylinders from being pulled or wrenched for entry, by interlocking the cylinders into the plate, thereby making this style of plate capable of being used on various types of cylinders regardless of the style of lock or door.

2. Description of the Prior Art

Lock cylinders have been provided in prior art that are used in every type of door, regardless of the types or sizes of the cylinder or doors. There is no plate on the market today which utilizes the principle of this interlocking system.

Since there is no prior art suitable for the particular purpose stated above, there is a need for the present invention as heretofore described.

SUMMARY OF THE INVENTION

A principle object of the present invention is to provide a method of protecting lock cylinders from being pulled or wrenched from their locks for easy entry, by utilizing an interlocking system built into the plate. This plate having a hole in the top back enables you to insert the cylinder face into it. Then slide plate up. The cylinder face ledge will then slide down into the cutout groove also embedded in the back of the plate. Being the bottom hole in the back of the plate is smaller, the cylinder will now be held into the back of the plate. Just tighten the cylinder into the lock. This will draw the bottom of the plate tight to the door. Drill through the bolt hole which is through the top of the plate and go through the door. Now insert the bolt through the plate and the door. Then tighten the bolt from the inside of the door. This will draw the top of the plate tight to the door.

You can use this same procedure with any cylinder regardless of the size of the door or type of cylinder.

A further object is to provide a plate which is economical to manufacture.

A still further object is to provide a plate which will work on all doors regardless of size, and being simple and easy to install.

To the accomplishment of the above related object, This invention may be embodied in form illustrated in the accompanying drawings, attention being called to the fact, however, that the drawings are illustrative only, and that changes may be made in specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
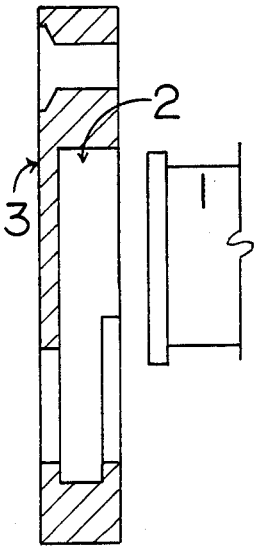
FIG. 1 is an exploded perspective view of the cylinder being inserted into the large hole in the back of the plate.
Figure 2:
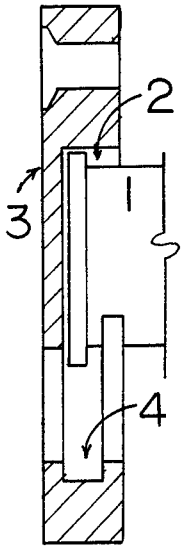
FIG. 2 is an exploded perspective view of the plate being slid up over the face of the cylinder and the cylinder sliding down into the milled groove in back of the plate, therefore locking the cylinder, into the back of the plate.
Figure 3:
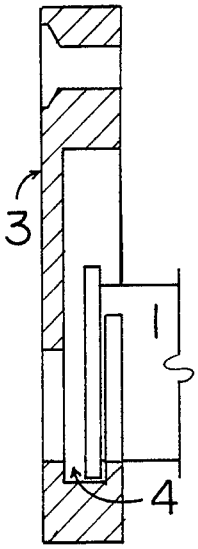
FIG. 3 is an exploded perspective view of the cylinder now locked into the back of the plate securely.
Figure 4:
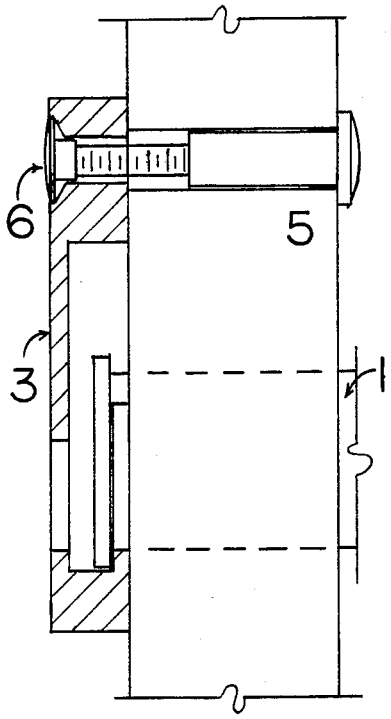
FIG. 4 is an exploded perspective view of the plate with the cylinder now locked into the back of the plate while being tightened securely against the door.
Figure 5:
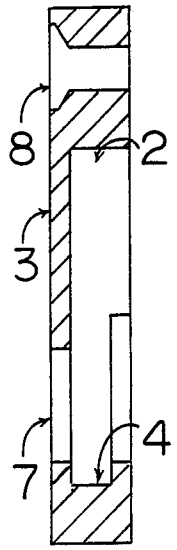
Figure 6:
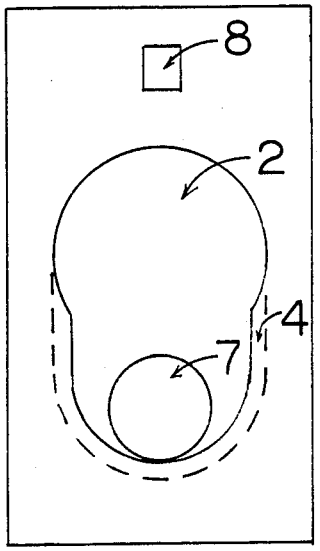
Figure 7:
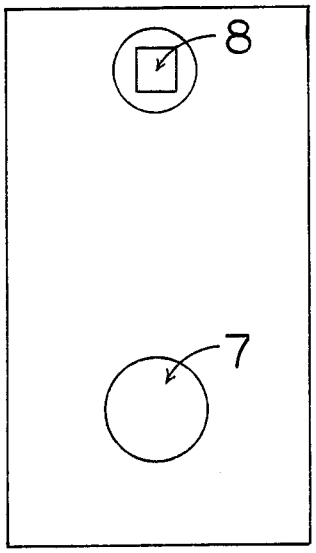

Turning now descriptively to the drawings in which similar reference characters denote similar elements through out the several views. FIGS. 5, 6, and 7 best illustrates the basic parts of the invention, being a plate.

FIGS. 5, 6, and 7 is a plate 3, consisting of keyhole 7, bolthole 8, large top hole 2, milled groove 4.

To understand how the plate 3, is used to lock the cylinder into its body, the following steps are described and illustrated in FIGS. 1 through 4 for: protecting the cylinder from being pulled or wrenched out of a lock for entry.

1. Insert cylinder 1, into large top hole 2, in back of plate 3.

2. Once cylinder 1, is seated in top hole 2, in back of plate 3, take plate 3, and slide up. Cylinder 1, will slide into milled groove 4, locking the cylinder 1, secured into groove 4, and held securely into back of plate 3.

3. Cylinder 1, will now be locked into groove 4, and held securely into back of plate 3.

4. Tighten cylinder 1, through door 5, then insert bolt 6, through plate 3, and door 5. Tighten bolt from inside of door 5.

What is claimed is:

1. An interlocking plate for securing lock cylinders against forceable removal or forceable entry, said plate having a front side and a back side and a cylinder engaging end and a securing end, comprising:

an elongated opeing in said back of said plate at said cylinder engaging end, said elongated opening have a lock insertion portion with a dimension sufficient to accommodate insertion of the face of a lock cylinder, said elongated opening further including an interlocking portion having a cylinder face engaging lip for sliding receipt of the face of said cylinder therebehind whereby said cylinder engaging end is secured to said lock cylinder;

means for securing said plate at said securing end; and cylinder face aperture in said front side located opposite elongated opening for access to said cylinder face when said device is mounted on said lock cylinder.

2. The device of claim 1 wherein said means for securing said plate comprises a grooved aperture in said back of said device at said securing end for threaded engagement with a threaded bolt.

3. A method of protecting lock cylinders from being forcibly removed or forcibly entered, regardless of the style of cylinder or type of door comprising:

providing an interlocking plate having a front side and a back side and a cylinder engaging end and a securing end, said back side including an elongated opening at the cylinder engaging end, said elongated opening having a lock insertion portion with a dimension sufficient to accommodate insertion of the face of a lock cylinder and an interlocking portion having a cylinder face engaging lip for sliding receipt of the face of said cylinder, means for securing said plate at said securing end, and cylinder face aperture in said front side located opposite said elongated opening for access to said cylinder face once said plate is mounted on said lock cylinder;

inserting the face of a cylinder in the lock insertion portion of the elongated opening;

sliding said plate in a direction toward said securing end whereby said cylinder face slides behind said cylinder face engaging lip and faces said aperture in said front side;

tightening said lock cylinder whereby said cylinder engaging end of said plate is drawn tight against a door;

providing access to the said means for securing said plate at said securing end; and inserting a securing device through said door at said securing end whereby said securing end of said plate is tightened against said door.

4. The method of claim 3 wherein said securing means comprises a grooved aperture for cooperative receipt of a threaded bolt, and access is provided through a door for insertion of a bolt therethrough.

* * * * *